US010954599B2

(12) United States Patent
Saman

(10) Patent No.: US 10,954,599 B2
(45) Date of Patent: Mar. 23, 2021

(54) WASHING ASSEMBLY FOR SHEET METALS FOR PRODUCING DOUBLE-LAYERED COPPER-COATED PIPES

(71) Applicant: NET BORU SANAYI VE DIS TICARET KOLLEKTIF SIRKETI BORA SAMAN VE ORTAGI, Istanbul (TR)

(72) Inventor: Bora Saman, Istanbul (TR)

(73) Assignee: NET BORU SANAYI VE DIS TICARET KOLLEKTIF SIRKETI BORA SAMAN VE ORTAGI, Istanbul (TR)

( * ) Notice: Subject to any disclaimer, the term of this patent is extended or adjusted under 35 U.S.C. 154(b) by 78 days.

(21) Appl. No.: 16/324,047

(22) PCT Filed: Aug. 8, 2017

(86) PCT No.: PCT/TR2017/050380
§ 371 (c)(1),
(2) Date: Feb. 7, 2019

(87) PCT Pub. No.: WO2018/030974
PCT Pub. Date: Feb. 15, 2018

(65) Prior Publication Data

US 2019/0169758 A1 Jun. 6, 2019

(30) Foreign Application Priority Data

Aug. 8, 2016 (TR) ..... 2016/11090

(51) Int. Cl.
*C23G 3/02* (2006.01)
*C25D 5/48* (2006.01)
(Continued)

(52) U.S. Cl.
CPC ..... *C23G 3/025* (2013.01); *C23G 3/02* (2013.01); *C25D 5/48* (2013.01); *C25D 7/0614* (2013.01); *C25D 21/08* (2013.01); *C25D 3/40* (2013.01)

(58) Field of Classification Search
CPC ..... C25D 5/48; C25D 21/08; C25D 7/0614; C25D 3/40; C23G 3/025; C23G 3/02
See application file for complete search history.

(56) References Cited

U.S. PATENT DOCUMENTS 2,522,071 A 9/1950 Tait
2,685,701 A * 8/1954 Booke ..... H01H 11/00 15/102
(Continued)

FOREIGN PATENT DOCUMENTS

CN 101440497 A 5/2009
DE 887291 C 8/1953
(Continued)

OTHER PUBLICATIONS

International search report and written opinion, dated Jun. 4, 2018, of International Application No. PCT/TR2017/050380; 11 pgs.

*Primary Examiner* — Benjamin L Osterhout
(74) *Attorney, Agent, or Firm* — Kilpatrick Townsend & Stockton LLP

(57) ABSTRACT

The present invention is a washing assembly having at least one washing chamber at which at least one sheet metal passing through for producing copper-coated double-layer steel pipe. The washing assembly comprises at least one pair of wiper pair accommodated by the washing chamber.

11 Claims, 2 Drawing Sheets

(51) Int. Cl.

| | |
|---|---|
| ***C25D 7/06*** | (2006.01) |
| ***C25D 21/08*** | (2006.01) |
| *C25D 3/40* | (2006.01) |

(56) References Cited

U.S. PATENT DOCUMENTS

| | | | | |
|---|---|---|---|---|
| 6,149,781 | A * | 11/2000 | Forand | C25F 1/00 204/239 |
| 8,393,293 | B2 * | 3/2013 | Kawashita | C25D 17/02 118/400 |
| 2003/0041912 | A1 | 3/2003 | Esser | |

FOREIGN PATENT DOCUMENTS

| | | | |
|---|---|---|---|
| DE | 10234705 | A1 | 5/2003 |
| EP | 0520324 | A1 | 12/1992 |
| JP | H11229084 | A | 8/1999 |

* cited by examiner

WASHING ASSEMBLY FOR SHEET METALS FOR PRODUCING DOUBLE-LAYERED COPPER-COATED PIPES

RELATED APPLICATIONS

This application is a U.S. National Phase of International Application No. PCT/TR2017/050380, filed Aug. 8, 2017, claiming priority to Turkish Patent Application No. 2016/11090, filed Aug. 8, 2016, contents of which are hereby incorporated by reference in their entirety.

TECHNICAL FIELD

The invention relates to a washing assembly in which a washing process is performed on a sheet metal used in the production of double-layered and copper-coated steel pipes.

THE PRIOR ART

In the present technique, copper coated double layer steel pipes are used as brake and fuel pipes in the automotive industry. During production, the steel sheet is forwarded in the forward direction, after the certain production phases, is subjected to pre-coating process using pre-coating chemical in the precoating container. The sheet metal coming out of the pre-coating container is covered with copper by electrolysis using a coating chemistry. Copper coated sheet metal is free from coating chemicals with water in the washing assembly. Then, the copper-coated steel sheet metals passing through certain production stages such as lacquering and drying are finally converted into double-layered pipes by the folding and joining methods known in the art. As an example of this method, applications of US20030041912 or JP11229084 for the known state of the art can be given. However, in the known technique, sheet metals can not be effectively cleaned from the chemicals on their surfaces before the lacquering process. This affects the quality of the lacquering process applied to the sheet metals after the washing process. B

BRIEF DESCRIPTION OF THE INVENTION

The object of the invention is to improve the efficiency of the washing process applied for the removal of the chemicals in the surface after the copper coating of the sheet metals used in the production of copper-coated double layer steel pipe.

In order to achieve the said object, the invention is a washer device having at least one washing chamber extending from the inside through which at least one sheet metal is passed to be used for producing copper-coated double-layer steel pipe from inside. In the washing chamber of the washing assembly there is at least one pair of stripping devices. Thus, the free removal of the chemicals present in both sides of the sheet metal is provided.

In a possible embodiment of the invention, wiper pair comprises two holding members extending linearly opposite to each other and two wiping members located in the holding members. Thus, wiping members are provided to remove the surfaces of the sheet metal from the chemicals.

In another possible embodiment of the invention, the holding members have at least one channel which opens into the washing chamber and into which end part of the wiping members is located. Thus, a channel in which the wiping member is located is provided.

In another possible embodiment of the invention, the channel has a front part having a width through which a free end of the wiping member passes. Thereby, a rear part is provided which the wiping member can hold the channel.

In another possible embodiment of the invention, end part is in the form of a projection. Thus, when the sheet metal passes through the wiping members, the wiping member is placed at the rear part of the channel, preventing from coming out of the channel.

In another possible embodiment of the invention, the free end is in a form bent is closer to the sheet metal. Thus, during the movement of the sheet metal in the forward direction, it is ensured that the wiping member is in contact with the surfaces of the sheet metal longitudinally.

In another possible embodiment of the invention, the washing chamber has at least one front wall which supports a folding part of the wiping member. Thus, the bending portion of the wiping member is supported to enhance the efficiency of contact of the wiping members with the surfaces of the sheet metal.

In another possible embodiment of the invention, the wiping member is made from a flexible material. Thus, during the passage between the wiping members of sheet metal, the flexing of the wiping members is provided.

In another possible embodiment of the invention, the flexible material is a rubber material. Thus, a resilient material is provided for the wiping members during the passage of the sheet metal.

In another possible embodiment of the invention, the washing assembly is a washing assembly having the wiper pair comprising wiping members configured to contact at least one side of the sheet metal. Thus, removal of at least one surface of the sheet metal from chemicals is provided.

DETAILED DESCRIPTION OF THE INVENTION

Figure 1:
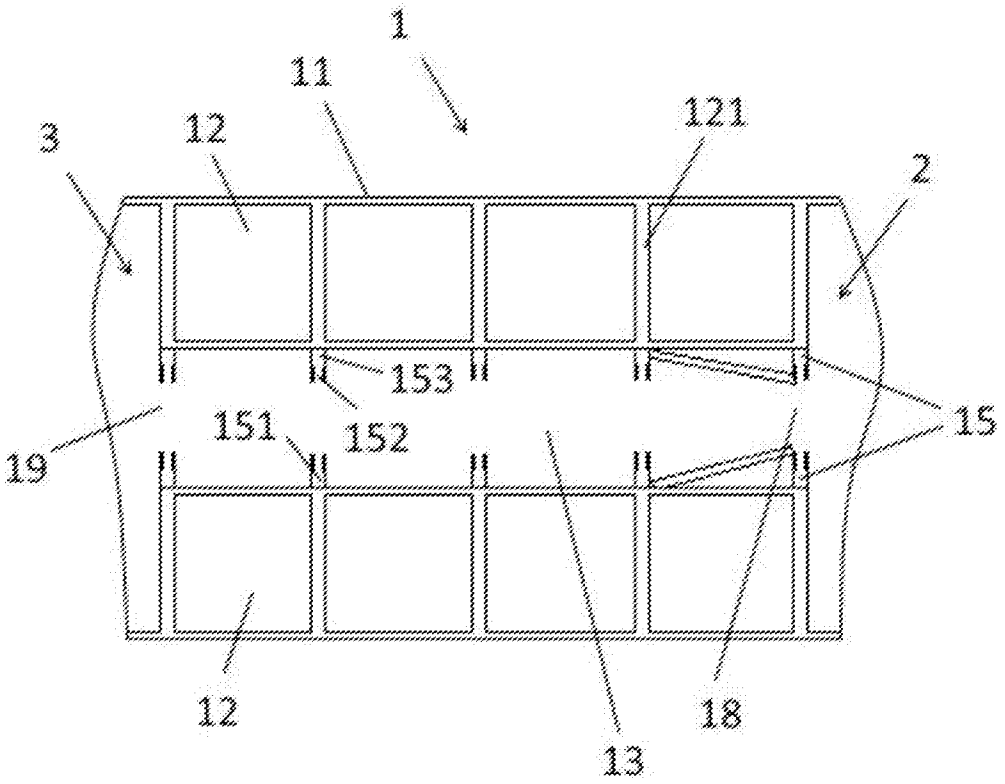
FIG. 1 is a top elevational represent view of the holding members of the inventive washing assembly.

Referring to FIG. 1, there are a washing assembly (1) in the production of sheet metals (4) used in the production of double-layered and copper-coated pipe, a coating container (2) in which the previous process of washing has been applied in the washing assembly (1) and a coating container (3) in which the next process of washing has been applied. The sheet metal (4) is subjected to copper coating process in a coating container (2) by electrolysis method using a cyanide copper coating solution. The sheet metal (4) coming out of the coating container (2) passes through an inlet (18) and reaches the washing assembly (1) as it progresses in a forward direction (F). In the washing assembly (1) the sheet metal (4) free of chemical, passes through an outlet (19) and forward to the lacquering container (3) for being subjected to lacquering.

The washing assembly (1) is surrounded by an outer wall (11) forming the outer periphery and has a rectangular shape similar to the periphery when viewed from above. At least one washing chamber (13) is provided on the inside of the washing assembly (1). The washing chamber (13) extends from the back of the washing assembly (1) and at least the sheet metal (4) passes through it. In the washing chamber (13) there is a washing liquid. In the preferred embodiment, said washing fluid is a demineralised water. On both sides of the washing chamber (13), there is at least one partition (12) which is situated opposite to each other. In a more detailed manner, the partitions (12) are positioned on both sides of the washing chamber (13) so as to be symmetrical about the axis of movement of the sheet metal (4). In a possible embodiment, each partition (12) is equal to each other. The partitions (12) are separated from each other by at least one inner wall (121) extending in a direction perpendicular to the forward direction (F) of the sheet metal (4).

The washing chamber (13) has at least one wiper pair (14). The wiper pair (14) comprises two holding members (15) extending linearly opposite to each other and two wiping members (17) located in the holding members (15). In a possible embodiment, an endpiece of the inner walls (121) extending into the washing chamber (13) is a holding member (15). In each holding member (15) there is at least one channel (151) which opens into the washing chamber (13). The channel (151) has a front part (152) having a width such that a free end (175) of the wiping member (17) can pass. A rear part (153) of the channel (151) is structured to be wider than the front part (152).

Figure 2:
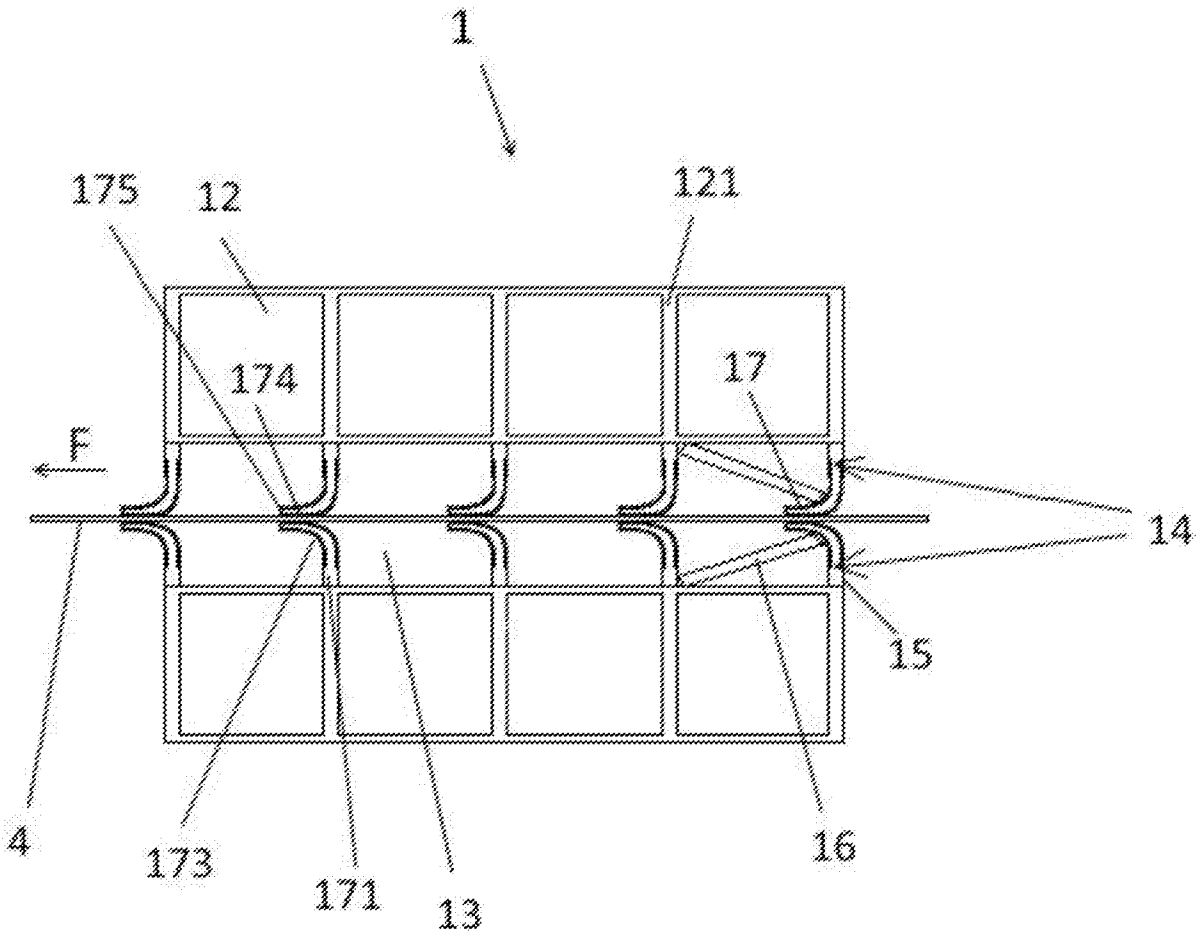
FIG. 2 is a top elevational represent view of the wiper pair of the inventive washing assembly.

Referring to FIG. 2, a wiping member (17) is located in the channel (151) of each holding member (15) in the washing assembly (1). In a more detailed description, locating an end part (171) of wiping member (17) into the channel (151) is provided in the form of a tight fit. In a possible embodiment, the end part (171) is in the form of a projection. The free end (175) of the wiping members (17) has a folding part (173). The free end (175) is in a twisted form, approximating the sheet metal (4). Due to the folding part (173) of the wiping member (17), the free ends (175) of the mutually located wiping member (17) extend in close proximity. The free ends (175) have at least one contact surface (174) in contact with the surfaces of the sheet metal (4) during the movement of the sheet metal (4). In the washing chamber (13), there is at least one front wall (16) which supports a folding part (173) of the wiping member (17). In a possible embodiment, the front wall (16) extends from a corner of the holding member (15) to the folding part (173) of the wiping member (17). The front walls (16) are positioned symmetrically with respect to the axis of movement of the sheet metal (4) and close to the inlet (18) of the washing chamber (13).

During the movement of the sheet metal (4) in the forward direction (F), the surfaces of the sheet metal (4) are stripped together with the washing liquid as they pass through the gap between the wiper pair (14). In this way, the sheet metal (4) passing through the plurality of wiper pair (14) is stripped by the number of the wiper pair (14). In a case where the washing assembly (1) is cleaned or the wiping members (17) have to be replaced, the wiping members (17) are placed in the partitions (12). In the case where the sheet metal (4) is going through, the wiping members (17) are placed in tight contact into the channel (151) of the holding members (15) so that the washing assembly (1) is ready for washing.

In a possible embodiment, the wiping member (17) is produced from a flexible material, and in a more probable embodiment, from a rubber material.

REFERENCE NUMBERS

1. Washing assembly
11. Outer wall
12. Partition
121. Inner wall
13. Washing chamber
14. Wiper pair
15. Holding member
151. Channel
152. Front part
153. Rear part
16. Front wall
17. Wiping member
171. End part
173. Folding part
174. Contact surface
175. Free end
18. Inlet
19. Outlet
2. Coating container
3. Lacquering container
4. Sheet Metal
F. Forward direction

The invention claimed is:

1. A washing assembly comprising:

at least one washing chamber extending between an inlet and an outlet, wherein:

the inlet is configured to receive at least one sheet metal coated with copper, the at least one washing chamber includes a washing liquid, the at least one sheet metal is configured to move through the washing liquid in the at least one washing chamber in a moving direction from the inlet toward the outlet, and the outlet is configured to output the at least one sheet metal to be formed into a copper-coated double-layer steel pipe after being freed of chemicals in the at least one washing chamber; and at least one pair of partitions provided on each side of the at least one washing chamber, each partition including an inner wall extending perpendicular to the moving direction of the at least one sheet metal;

at least one pair of wiper pair accommodated by the washing chamber and comprising two holding members extending linearly opposite to each other, each holding a wiping member, wherein the inner wall of each partition extends into the at least one washing chamber to form each holding member, wherein the wiping members are configured to contact opposite surfaces of the at least one sheet metal as the at least one sheet metal moves in the moving direction, and wherein during a movement of the at least one sheet metal, the opposite surfaces of the at least one sheet metal are stripped with the washing liquid by means of the at least one pair of wiper pair.

2. The washing assembly according to claim 1, wherein the holding members have at least one channel which opens into the washing chamber and into which end part of the wiping members is located.

3. The washing assembly according to claim 2, wherein the channel has a front part having a width through which a free end of the wiping member passes.

4. The washing assembly according to claim 2, wherein the end part is in the form of a projection.

5. The washing assembly according to claim 3, wherein the free end is in a twisted form, approximating the sheet metal.

6. The washing assembly according to claim 1, wherein the washing chamber has at least one front wall which supports a folding part of the wiping member.

7. The washing assembly according to claim 1, wherein the wiping member is made from a flexible material.

8. The washing assembly according to claim 7, wherein the flexible material is a rubber material.

9. The washing assembly according to claim 1, wherein the wiping members are configured to contact at least one side of the sheet metal.

10. The washing assembly according to claim 1, wherein the inlet is adjacent to a coating container and is configured to receive the at least one sheet metal from the coating container where the at least one sheet metal is coated with copper, the outlet is adjacent to a lacquering container and is configured to forward the at least one sheet metal to the lacquering container after being freed of chemicals in the at least one washing chamber, wherein the at least one sheet metal free of chemicals is lacquered in the lacquering container for producing the copper-coated double-layer steel pipe.

11. A system comprising:

the washing assembly of claim 10, the coating container adjacent to the inlet of the washing assembly; and the lacquering container adjacent to the outlet of the washing assembly.

* * * * *